US012698593B2

(12) United States Patent
Riihioja et al.

(10) Patent No.: US 12,698,593 B2
(45) Date of Patent: Aug. 4, 2026

(54) BELT

(71) Applicant: Valmet Technologies, Inc., Espoo (FI)

(72) Inventors: Vesa-Matti Riihioja, Tampere (FI); Tuomas Suoranta, Tampere (FI); Arsi Nikkinen, Jyväskylä (FI); Janne Honkanen, Jyväskylä (FI)

(73) Assignee: Valmet Technologies, Inc., Espoo (FI)

( * ) Notice: Subject to any disclaimer, the term of this patent is extended or adjusted under 35 U.S.C. 154(b) by 260 days.

(21) Appl. No.: 18/542,639

(22) Filed: Dec. 16, 2023

(65) Prior Publication Data

US 2024/0209571 A1 Jun. 27, 2024

(30) Foreign Application Priority Data

Dec. 27, 2022 (FI) ..... 20226166

(51) Int. Cl.
*D21F 3/02* (2006.01)
*D21F 1/40* (2006.01)

(52) U.S. Cl.
CPC ..... *D21F 3/0227* (2013.01); *D21F 1/40* (2013.01)

(58) Field of Classification Search
CPC ..... D21F 3/0227; D21F 1/40
See application file for complete search history.

(56) References Cited

U.S. PATENT DOCUMENTS 5,398,092 A * 3/1995 Tanno ..... G03F 7/3042 396/604
2005/0126733 A1* 6/2005 Fitzpatrick ..... D21F 3/0227 162/358.3
2007/0023156 A1* 2/2007 Hikita ..... D21F 3/0227 428/167
2009/0029051 A1* 1/2009 Fitzpatrick ..... D21F 3/0236 162/358.4
2017/0233946 A1* 8/2017 Sealey ..... B32B 7/05 162/111

* cited by examiner

*Primary Examiner* — Abbas Rashid
*Assistant Examiner* — Stephen M Russell
(74) *Attorney, Agent, or Firm* — Stiennon & Stiennon

(57) ABSTRACT

A belt (10) for a fiber web machine has an inner surface (11) and an outer surface (12). A plurality of parallel dewatering grooves are arranged in a first direction (D1) on the outer surface (12) of the belt (10), each dewatering groove having a width. A first dewatering groove (21) has shallow portions (30) having a first depth (32), and deep portions (40) having a second depth (42), which first and second depths (32, 42) are determined from the outer surface (12) of the belt (10) in a depth direction, wherein the first depth (32) is smaller than the second depth (42).

19 Claims, 4 Drawing Sheets

BELT

CROSS REFERENCES TO RELATED APPLICATIONS

This application claims priority on Finnish Application No. 20226166, filed Dec. 27, 2022, the disclosure of which is incorporated by reference herein.

STATEMENT AS TO RIGHTS TO INVENTIONS MADE UNDER FEDERALLY SPONSORED RESEARCH AND DEVELOPMENT

Not applicable

BACKGROUND OF THE INVENTION

This invention relates to a belt for a fiber web machine.

Fiber web machines, such as paper machines, as well as board, pulp, and tissue machines, are typically equipped with a forming section, a press section, and a drying section. In paper, pulp and board making, it is an issue how to increase the dewatering amount from a wet fiber web in order to improve production efficiency without decreasing the physical properties of the fiber web.

Nowadays, these machines typically have felts and wires to support water removal or conveying of the fiber web. Furthermore, fiber web machines may have a finishing section to improve the final product properties, such as calender machine(s) for improving smoothness of a dried fiber web.

It is well known that fiber web machines comprise many kinds of rolls located in different sections with distinguishing functions. For instance, a sleeve roll can be used in the forming section to improve the removal of free water from the wet fiber material. A shoe press can be used, for example, in press sections to improve the removal of residual water in the fiber web therein. Both the sleeve roll and the shoe press need a belt to be able to run properly.

However, there is still a need for new belts for fiber web machines.

SUMMARY OF THE INVENTION

An object of the present specification is to provide a belt for a fiber web machine.

A fiber web machine according to this specification can be a paper machine, or it can be a board, pulp, or tissue machine.

A fiber web machine may comprise a sleeve roll. The sleeve roll is typically located at a wire section of a fiber web machine. Thanks to the sleeve roll, water removal of the wire section can be improved. In an embodiment, the belt according to this specification is a sleeve roll belt.

A fiber web machine may comprise a shoe press. The shoe press is typically located at a press section of a fiber web machine. Thanks to the shoe press, water removal of the press section can be improved. Advantageously, the belt according to this specification is a shoe press belt. The novel dewatering grooves can be particularly advantageous when the belt is a shoe press belt.

The belt according to this specification has an inner surface and an outer surface. In use, the belt typically forms a closed loop. The belt can be an impermeable belt. Technical effects include that dewatering grooves can be used for removing water from fiber web fabrics, and an oil layer can be provided on the inner surface of the belt without affecting properties of the outer surface of the belt.

The belt can comprise a body comprising a body material. Further, the belt can comprise a reinforcing structure.

The outer surface of the belt can comprise a plurality of parallel dewatering grooves in a first direction. Each dewatering groove can have a width, determined in a second direction. The second direction is transverse to the first direction.

Preferably, the first direction does not deviate from a machine direction by more than 10°, and a second direction does not deviate from a cross direction by more than 10°. More preferably, the first direction does not deviate from the machine direction by more than 5°, and the second direction does not deviate from the cross direction by more than 5°. Most preferably, the first direction is the machine direction, and the second direction is the cross direction with respect to the first direction.

The belt comprises a first dewatering groove having deep portions and shallow portions. A technical effect of the shallow portions between deep portions is to intensify the removal of water, which can contribute to an increase in the web speed and the production efficiency in the machine having the dewatering grooves comprising the shallow and deep portions.

The shallow portion has a first depth, which first depth is determined as the smallest depth from the outer surface of the belt to a bottom of a shallow portion in a depth direction of the belt. The deep portion has a second depth, which second depth is determined from the outer surface of the belt to a bottom of the deep portion in the depth direction of the belt. The first depth of the belt is smaller than the second depth.

The first depth can be in a range between 0 mm and 1.20 mm, preferably in a range between 0.02 mm and 0.40 mm. Further, the second depth can be in a range between 0.8 mm and 1.6 mm, preferably in a range between 1 mm and 1.4 mm. The technical effect is to achieve more effective transfer of water from the fiber web to the dewatering grooves and better removal of water accumulated in the dewatering grooves from the dewatering grooves.

Preferably, the first depth is at least 1%, more preferably at least 2%, still more preferably at least 3%, and most preferably at least 5%, with respect to the second depth, determined from the outer surface of the belt in the depth direction. Furthermore, the first depth is preferably less than 75%, more preferably less than 50%, and still more preferably less than 25%, with respect to the second depth, determined from the outer surface of the belt in the depth direction. Technical effects include, among other things, enhanced water removal from a fiber web into the dewatering grooves and thereby a higher dry content of the fiber web.

The first depth can be at least 0.2%, such as in a range between 0.2% and 20%, with respect to a thickness of the belt. Alternatively, or in addition, the second depth can be in a range between 6% and 30%, with respect to the thickness of the belt. The technical effect is to maintain desired press ability properties of the belt while using the dewatering grooves to achieve effective transfer of water from the fiber web to the dewatering grooves.

Preferably, a number of the shallow portions is 1/m to 50/m, more preferably 20/m to 40/m, and most preferably 22/m to 30/m determined from one first dewatering groove in the first direction. The technical effect of said number is that the water flow rate in the dewatering groove is high and the removal of water from the dewatering groove is enhanced.

Each shallow portion has a central line determined as a location of the smallest depth (or a center of an area having the smallest depth) of the shallow portion.

A distance between central lines of two nearest shallow portions can be less than 1000 mm, preferably at least 20 mm and not greater that 100 mm, more preferably at least 25 mm and not greater than 70 mm, and still more preferably at least 32 mm and not greater than 53 mm measured from the first dewatering groove in the first direction. The technical effect is to enhance the advantageous effects caused by the shallow portions and achieve more controlled and better removal of water from the dewatering grooves.

The shallow portions have a cross sectional shape in the first direction, determined from the bottom of the dewatering groove to the top of the shallow portion.

Said cross sectional shape can taper towards the outer surface of the belt. The technical effect is that said tapered shape gives a smooth transition without sharp edges, causing grooves to stay cleaner from small fibers, filling additives, etc., as well as improving water removal from the dewatering grooves.

In an embodiment, the shallow portions are arranged in such a way that each shallow portion extends from a bottom of the first dewatering groove in a direction forming an angle of at least 5° and equal to or less than 90°, preferably equal to or less than 80°, to the bottom of the first dewatering groove. The technical effect is to improve fine tuning properties of the belt. The angle has also an effect on the amount of water to be removed.

The shallow portions can have a first length, and the deep portions can have a second length, determined from the first dewatering groove in the first direction. The first length can be in a range between 5 mm and 35 mm, preferably in a range between 7 mm and 15 mm, measured from the first dewatering groove in the first direction. The second length can be in a range between 10 mm and 90 mm, preferably in a range between 20 mm and 45 mm, measured from the first dewatering groove in the first direction. The technical effect of this combination is to improve water removal from the fiber web into the dewatering grooves and better removal of water from the dewatering grooves.

An average length of the shallow portions is preferably smaller than an average length of the deep portions, determined in the first direction. Preferably, each shallow portion has a first length of equal to or less than 60%, preferably equal to or less than 50% of the average length of the deep portions, determined from the first dewatering groove in the first direction. The technical effect is to improve removal of water from the fiber web to the dewatering grooves and hence to obtain higher dry content of the fiber web to be dewatered.

An average width of the shallow portions can be at least 8% and equal to or less than 100% of the width of the first dewatering groove, preferably the average width of the shallow portions is at least 35% and equal to or less than 100%, more preferably equal to or more than 50%, and most preferably equal to or more than 70% of the width of the first dewatering groove, determined in the second direction. The technical effect is to avoid marking of the fiber web to be dewatered, particularly in cases where the shallow portions have a substantially small depth.

A total amount of said first dewatering grooves, i.e., dewatering grooves having said shallow portions and said deep portions, can be at least 50%, preferably at least 99%, and most preferably 100%, determined from a total amount of all dewatering grooves. The technical effect is to achieve more effective transfer of water from a fiber web to the dewatering grooves and more controlled and better removal of water from the dewatering grooves. Another technical effect is to improve the dewatering efficiency and thereby the production efficiency of a dewatering section of the fiber web machine.

The dewatering grooves are arranged to form a total volume for water. Preferably, said total volume is from 100 to 600 ml per $m^2$, more preferably 200 to 500 ml per $m^2$. The technical effect is to provide such total volume which can be used to achieve higher dewatering and dry content of the fiber web to be dewatered and thereby to improve the production efficiency of the fiber web machine.

Thus, the novel belt has many advantages. For example, thanks to the shallow portions between deep portions, higher dry content of the fiber web can be achieved by enhancing the removal of water from the dewatering grooves, as the deep portions can collect water and the shallow portions can force the water off from the belt. In this way, the deep and shallow portions have a strong effect on the dewatering process in order to achieve a higher dry content of the fiber web.

BRIEF DESCRIPTION OF THE DRAWINGS

In the following, the invention will be illustrated by drawings.

FIG. 2*b* shows an example of shallow and deep portions in a belt.

FIG. 2*c* is an enlarged fragmentary view of a portion of FIG. 2*b*.

The figures show some examples of a belt. The figures are illustrations which may not be in scale. Similar parts are indicated in the figures by the same reference numbers.

DESCRIPTION OF THE PREFERRED EMBODIMENTS

Figure 1A:
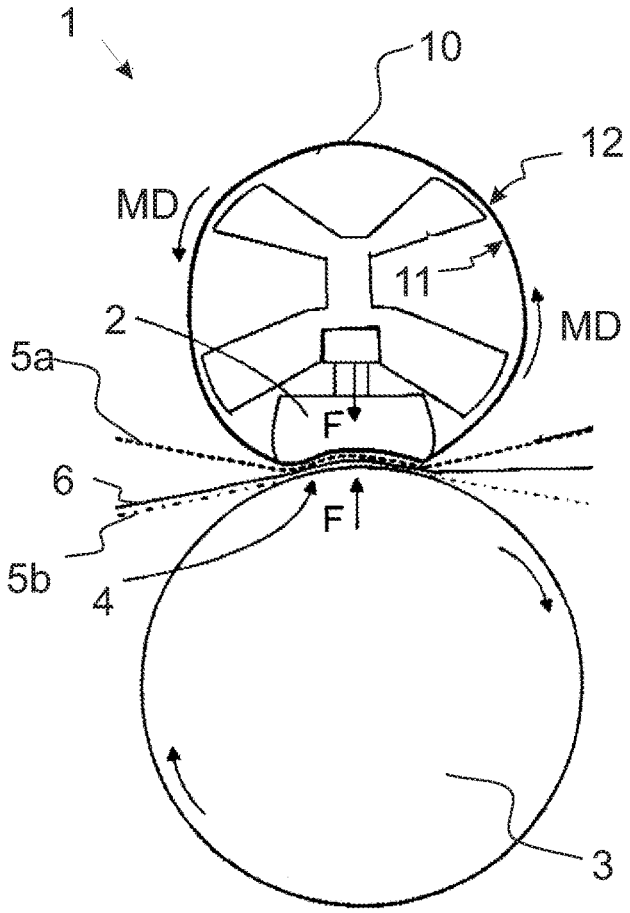
FIG. 1*a* illustrates an example of a shoe press, including a belt installed in the shoe press.

The solution is described in the following in more detail with reference to some embodiments, which shall not be regarded as limiting.

In this specification, references are made to the figures with the following numerals and denotations:

D1 first direction of the belt,
D2 second direction of the belt,
MD travel direction of the belt,
CD cross direction of the belt,
C1 first curve of the sleeve roll,
C2 second curve of the sleeve roll,
1 shoe press,
2 press shoe,

3 counter roll,
4 press zone,
5, 5*a*, 5*b* fiber web machine fabric, e.g., a wire or a felt,
6 fiber web,
7 sleeve roll,
8 support shaft of the sleeve roll,
9 curve element of the sleeve roll,
10 belt,
10*a* thickness of a body of the belt,
11 inner surface of the belt,
12 outer surface of the belt,
13*a* first end of the belt,
13*b* second end of the belt,
14 body of the belt,
15 attaching point of the belt,
16 outer edge of the belt,
21 first dewatering groove,
22 width of a dewatering groove,
23 land between two adjacent dewatering grooves,
24 width of the land,
30 shallow portion of the first dewatering groove,
31 center line of the shallow portion,
32 first depth, i.e. depth of the shallow portion,
33 a distance between central lines of two nearest shallow portions in the first direction,
34 a length of the shallow portion in the first direction,
40 deep portion of the dewatering groove,
42 depth of the deep portion, and
44 a length of the deep portion in the first direction.

The embodiments and examples recited in the claims and in the specification are mutually freely combinable unless otherwise explicitly stated.

In this specification, the term "comprising" may be used as an open term, but it also comprises the closed term "consisting of". Thus, unless otherwise indicated, the word "comprising" can be read as "comprising or consisting of".

For the purpose of the present description and the claims, unless otherwise indicated, all ranges include any combination of the maximum and minimum points disclosed, and include any intermediate ranges therein, which may or may not be specifically enumerated herein.

Unless otherwise indicated, all ranges and values are determined from a new belt. For example, a groove depth can decrease as the belt wears.

In this specification, the term "thickness" refers to a depth direction of the belt. On the other hand, the term "depth" refers to a thickness direction of the belt.

In this specification, the terms "travel direction" MD and "cross direction" CD are used. The travel direction MD (i.e., the direction of running) refers to the direction of rotation of the belt in use. The cross-direction CD refers to the direction transverse to the travel direction MD of the belt. In use, the cross-direction is substantially parallel to the axis of rotation of the belt.

In this specification, the term "substantially parallel" means that one direction does not deviate from said substantially parallel direction by more than 10 degrees, preferably not by more than 3 degrees. Thus, e.g. "substantially parallel to the travel direction" means, in this specification, that a direction does not deviate from said travel direction by more than 10 degrees, and preferably not by more than 3 degrees.

A fiber web machine according to this specification may comprise at least one of a sleeve roll and a shoe press.

Shoe Press

Referring to FIG. 1*a*, a fiber web machine may comprise a shoe press 1.

The belt 10 can be a shoe press belt.

The shoe press equipped with the belt 10 can be used for dewatering a fiber web. The shoe press typically comprises a counter roll 4 and a press shoe 2, a press zone being formed between them. Thus, an extended press zone 4, i.e., a so-called long nip, is formed between the press shoe 2 and the counter roll 3. The function of the shoe press is typically to remove water from the fiber web.

The belt is or can be arranged in connection with the shoe press in such a way that, in operation, the belt runs through the press zone between a counter roll and the press shoe.

Typically, the press shoe and the counter roll are pressed against each other in the press zone in such a way that 1) the shoe press belt,
2) at least one paper machine fabric, and
3) the fiber web to be dewatered are compressed in the nip between the press shoe and the counter roll.

Sleeve Roll

Figure 1B:
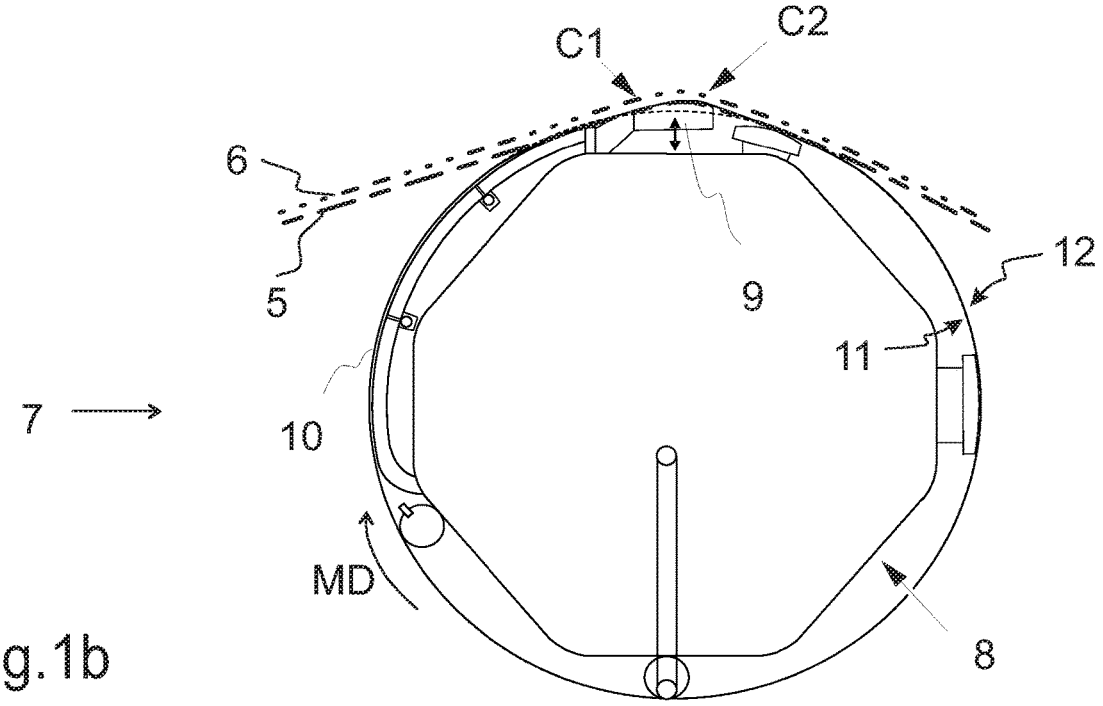
FIG. 1*b* illustrates an example of a sleeve roll, including a belt installed in the sleeve roll.

Referring to FIG. 1*b*, a fiber web machine may comprise a sleeve roll 7.

The belt 10 can be a sleeve roll belt.

The sleeve roll 7 can be located in the forming section for improving water removal therein. The sleeve roll 7 equipped with the belt 10 can be used for dewatering a fiber web 6 on a wire 5.

The belt 10 can be located around an outer surface of the sleeve roll 7. The sleeve roll can comprise a support shaft 8. Thus, the belt 10 can be led to circle around the support shaft 8. Further, the sleeve roll 7 can comprise support elements located at a distance from each other on the support shaft 8. The belt 10, which can circle around the outer surface of the sleeve roll, can be supported by the support elements.

The belt 10 may be arranged in connection with the sleeve roll 7 in such a way that its outer surface 12 faces the fiber web 6 and its inner surface 11 faces the sleeve roll 7. Thus, the sleeve roll 7 can be encircled by the belt 10 having the shape of a loop.

The sleeve roll 7 can further comprise a curve element 9. In operation, the belt typically runs through the dewatering zone on the curve element. Further, wire(s) 5 can be led via the curvilinear dewatering zone C1, C2, which dewatering zone can be supported by the belt 10. The curvilinear dewatering zone C1, C2 can comprise at least two partial curves C1, C2 such that the radius of curvature of a first partial curve C1 may be greater than the radius of curvature of a second partial curve C2 following the first partial curve in the travel direction MD of the belt. This can improve the water removal from the fiber web. The curve element 9 can be movable, i.e., a radius of curvature of the belt on the surface of the curve element can be controlled by moving the curve element.

Belt

The belt 10 according to this specification can be arranged to be a sleeve roll belt. Preferably, the belt according to this specification is arranged to be a shoe press belt.

The belt can have an inner surface 11, and an outer surface 12. The belt can form, at least in operation, a closed loop, i.e., the belt 10 can be shaped like an endless loop.

The belt 10 has a circumference, which is a length of one rotation, and a thickness 10*a*. The thickness is the smallest dimension of the belt. The circumference can be selected for adapting the belt to a sleeve roll, or to a shoe press. The circumference of the belt 10 is determined to be such that the inner diameter of the belt 10, when in operation, will be suitable for the purpose. The circumference of the belt 10, is determined to be such that the inner diameter of the belt 10, when in operation, will be suitable for the use. Circumferences of belts may differ. An inner diameter of the belt may be, for example, in a range between 700 mm and 2000 mm.

The belt 1 can be an impermeable belt. Thus, it is possible to use e.g., an oil layer on the inner surface 11 of the belt without affecting properties of the outer surface 12 of the belt.

The thickness 10*a* of the belt can be at least 2 mm, more preferably at least 3 mm, and most preferably equal to or more than 3.5 mm. The thickness 10*a* of the belt can be equal or less than 8 mm, more preferably equal to or less than 7 mm, and most preferably equal to or less than 6 mm. The technical effect is to provide a structure wherein the belt having the dewatering grooves has good strength properties, particularly for sleeve roll belts and shoe press belts.

The belt comprises a plurality of parallel dewatering grooves on the outer surface of the belt, arranged in the first direction D1. Each dewatering groove has a width, determined in the second direction D2.

Preferably, the dewatering grooves extend in the machine direction MD, i.e., direction of rotation of the belt 10 in use, or at least substantially in the direction of rotation of the belt 10 in use.

Figure 2A:
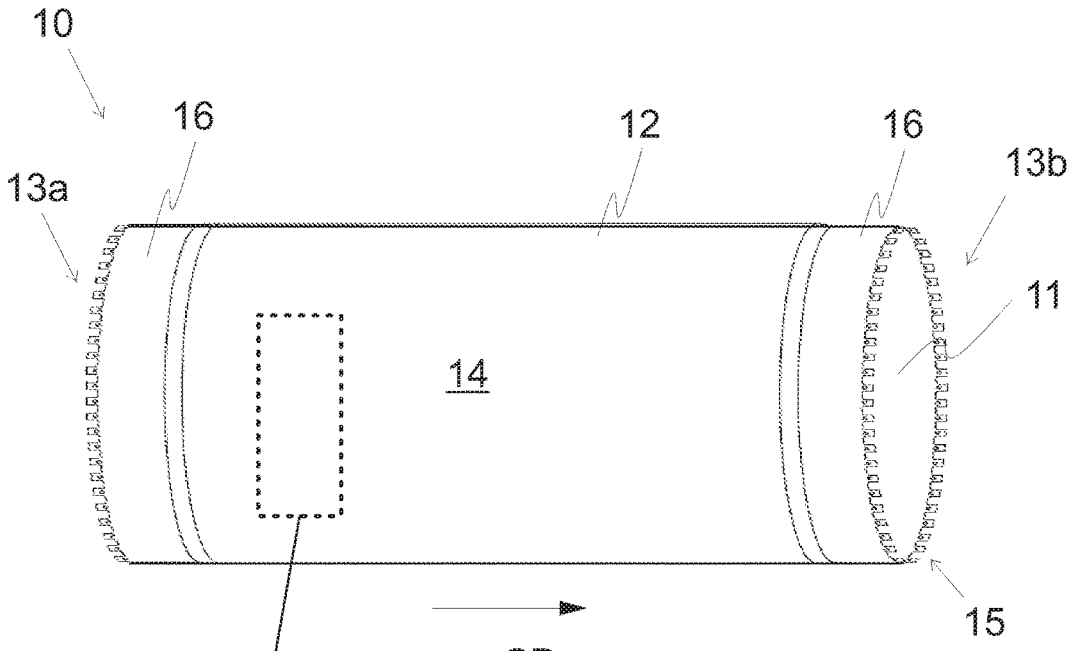
FIG. 2*a* illustrates an example of a belt.
Figure 2B:
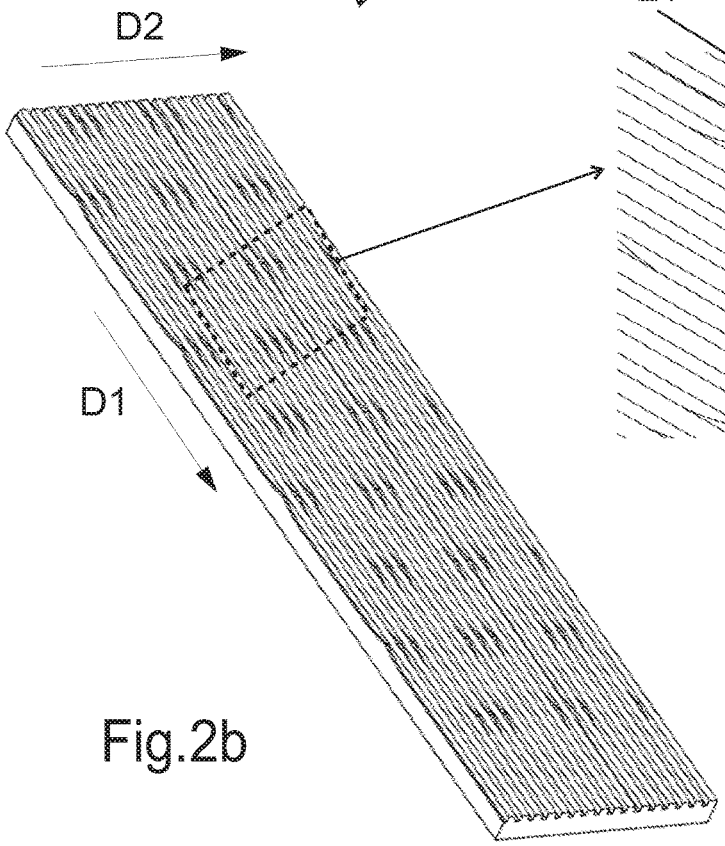
FIGS. 2*b-c* illustrate an example of dewatering grooves in a belt.
Figure 2C:
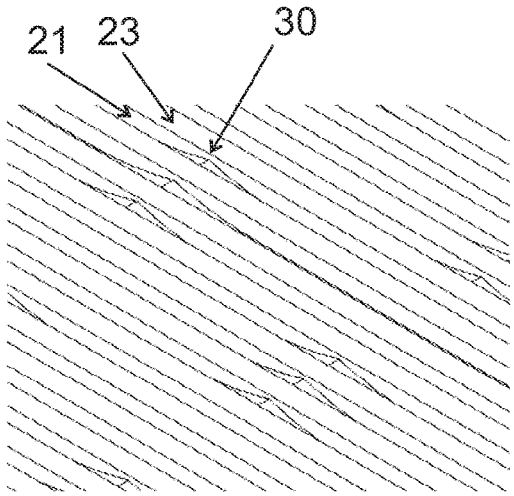

As shown in FIG. 2*c*, a land 23 is provided between two adjacent dewatering grooves. Thus, the belt has a plurality of parallel lands 23 between adjacent dewatering grooves. The land(s) 23 can have a width in a range between 0.8 mm and 5 mm, preferably in a range between 1 mm and 3 mm, and most preferably in a range between 1.1 mm and 2.5 mm. Alternatively or in addition, a distance between central lines of two parallel and adjacent dewatering grooves can be in a range between 1.5 mm and 7 mm, preferably in a range between 1.8 mm and 5.5 mm, and most preferably in a range between 2.0 mm and 4.5 mm. Alternatively or in addition, a width 22 of the dewatering grooves can be in a range between 0.5 mm and 2 mm, preferably in a range between 0.7 mm and 1.8 mm, and most preferably in a range between 0.8 mm and 1.6 mm. The technical effect of said widths and distance together with shallow and deep portions is to optimize water removal from a fiber web to be dewatered without causing unwanted marking to said fiber web.

The first dewatering groove 21 has shallow portions and deep portions arranged along the first dewatering groove in the first direction, wherein the shallow portions have a first depth, and the deep portions have a second dept. The first depth is smaller than the second depth. The technical effect is that the water can be removed from the web to the dewatering groove effectively.

The first depth of the shallow portion 30 can be equal to or more than 0 mm, such as in a range between 0 and 1.20 mm, preferably in a range between 0.01 mm and 1.0 mm, more preferably in a range between 0.02 mm and 0.8 mm, still more preferably in a range between 0.04 mm and 0.6 mm, still more preferably in a range between 0.05 mm and 0.4 mm, and most preferably equal to or less than 0.2 mm, determined as the smallest depth of the shallow portion from the outer surface of the belt to the bottom of the shallow portion. The technical effect is that less rewetting can take place with respect to the fiber web. Another technical effect is to avoid both back splash phenomena as well as marking of the fiber web to be dewatered.

The second depth of the deep portion 30 can be equal to or more than 0.8 mm, preferably in a range between 0.9 mm and 1.6 mm, more preferably in a range between 1 mm and 1.5 mm, and most preferably in a range between 1.1 mm and 1.4 mm, determined from bottom of the deep portion to the outer surface of the belt. The technical effect of a combination of said second depth together with the first depth is to avoid back splash phenomena and rewetting. Preferably, the second depth is substantially the same through the deep portion.

The first depth can be at least 1%, more preferably at least 2%, still more preferably at least 3%, and most preferably at least 5%, with respect to the second depth. In addition, or alternatively, the first depth can be less than 75%, preferably less than 50%, and still more preferably less than 25%, with respect to the second depth, determined from the outer surface of the belt in the depth direction. The technical effect is to decrease marking caused by the belt and, hence, to improve surface properties of the fiber web to be manufactured. A further technical effect of the decreased marking level is to achieve better properties of the final product, such as coated and/or calendered fiber web.

The first depth is preferably at least 0.2%, such as in a range between 0.2% and 29%, preferably in a range between 2% and 15%, with respect to a thickness of the belt. Further, the second depth can be in a range between 6% and 30%, preferably in a range between 10% and 25%, with respect to the thickness of the belt. The technical effect is to achieve effective dewatering of the fiber web to be dewatered.

With the above-mentioned depths of the shallow and deep portions, water can be removed from the web more efficiently via said first dewatering grooves. These benefits are typically realized the better, the more of the above-mentioned features are implemented in the belt.

Figure 3A:
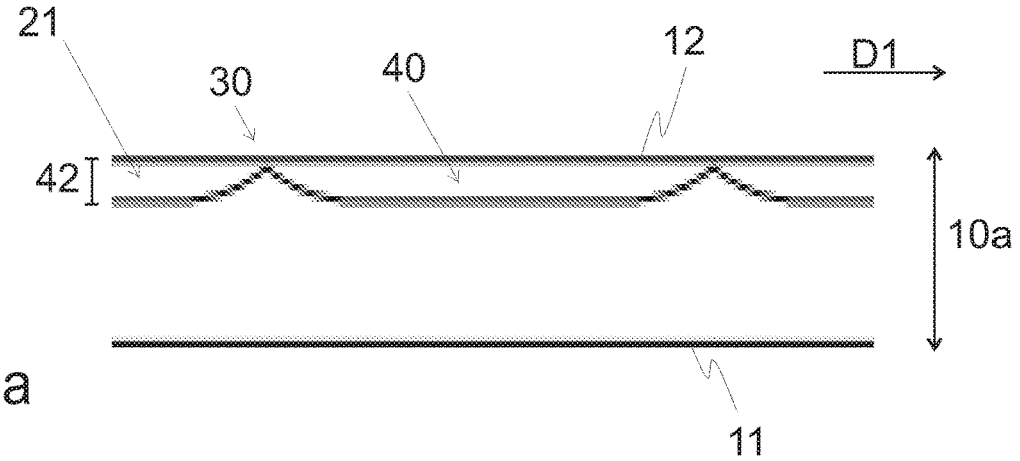
FIG. 3*a-b* illustrate examples of a part of one dewatering groove in a belt, in a cross-sectional view.
Figure 3B:
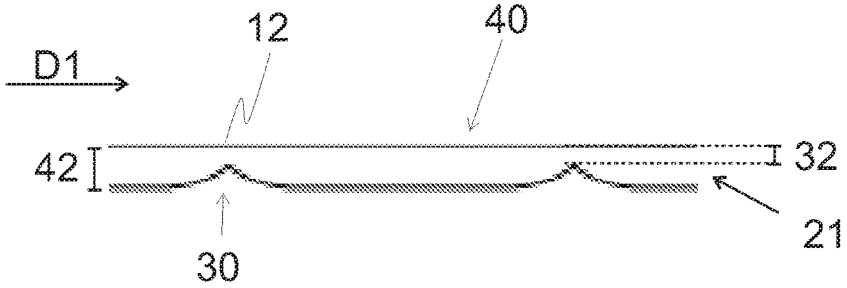
Figure 3C:
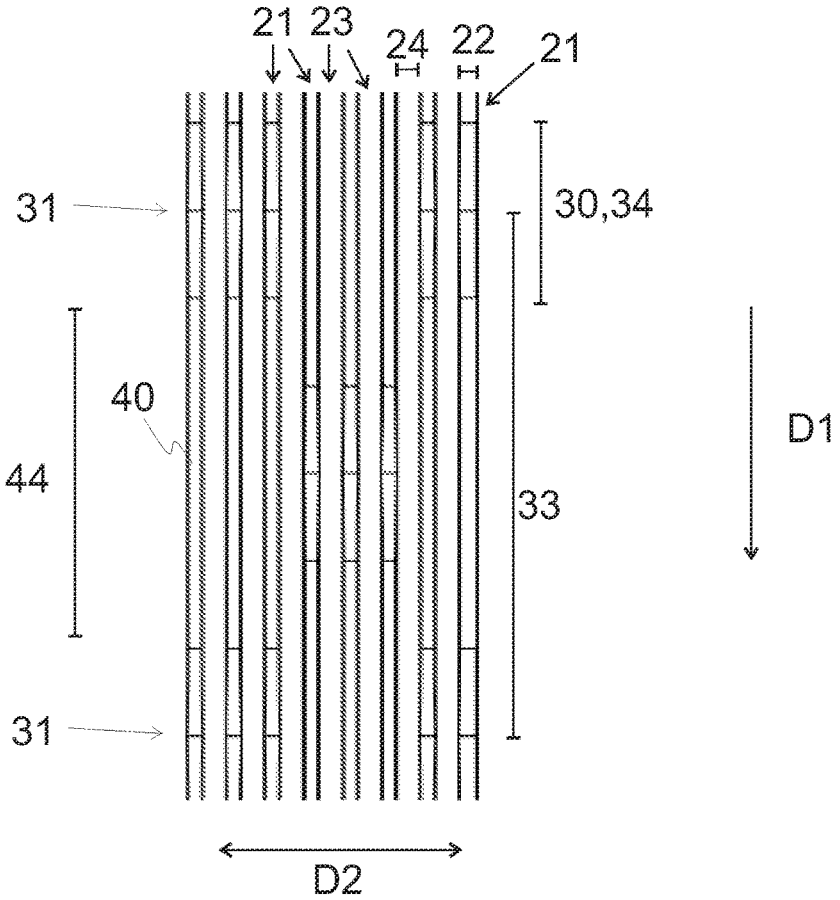
FIG. 3*c* illustrates of a part of a belt, from a top view.
Figure 4A:
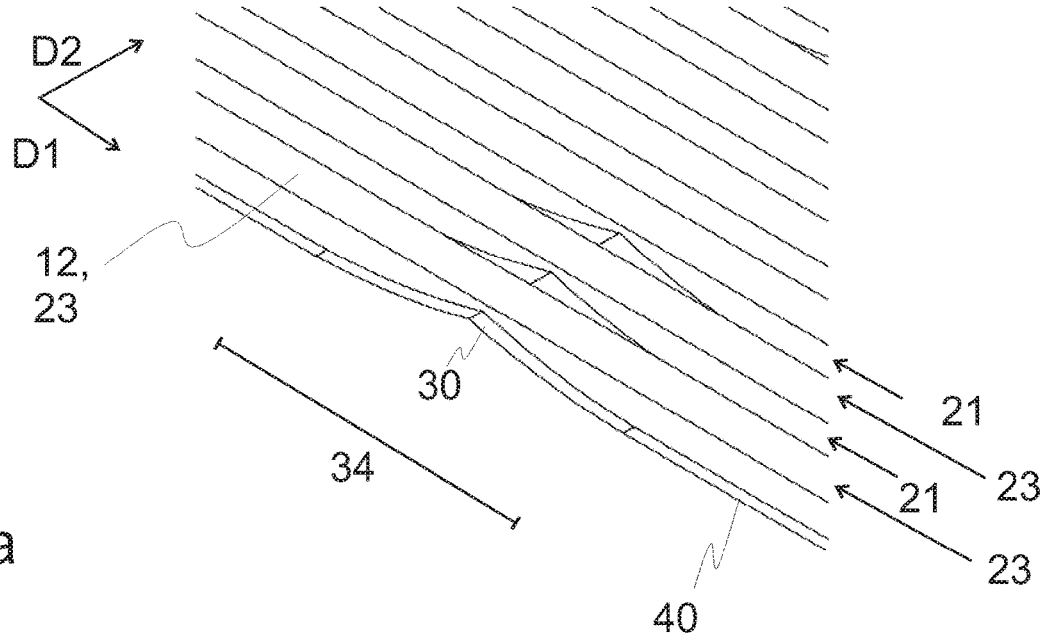
FIG. 4*a* illustrates an example of a part of dewatering grooves.
Figure 4B:
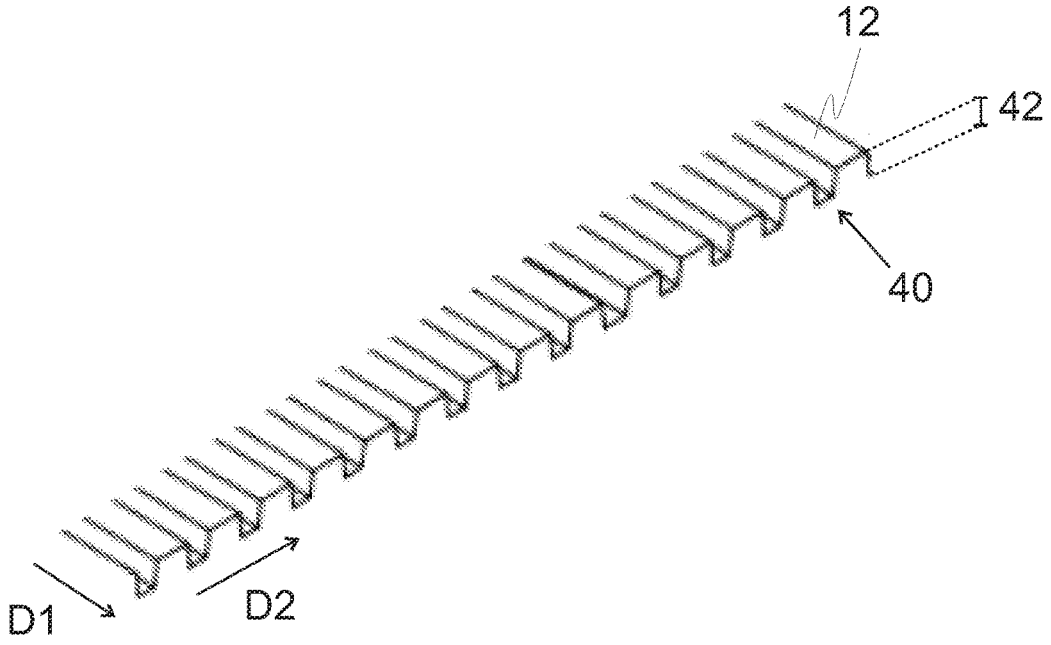
FIG. 4*b* illustrates an example of deep parts of dewatering grooves, in a cross-sectional view.

As shown in FIG. 3*c*, the distance 33 between central lines 31 of two nearest shallow portions is preferably less than 1000 mm, more preferably less than 500 mm. To enhance the advantageous effects, a distance 33 between central lines 31 of two nearest shallow portions can be at least 20 mm and not greater that 100 mm, preferably at least 25 mm and not greater than 70 mm, and most preferably at least 30 mm and not greater than 50 mm determined from the first dewatering groove in the first direction.

The shallow portions in the first dewatering groove enhance the removal of water from the web, and their effectiveness can improve as the number of shallow portions is kept between 1/m to 50/m, preferably in a range between 20/m to 40/m, wherein the best result can be achieved when the number of said shallow portions is 22/m to 30/m, measured from the first dewatering groove 21 in the first direction D1. Another technical effect of said number of shallow portions is that the water can be removed from the web to the dewatering groove effectively and, furthermore, less rewetting can take place with respect to the fiber web.

To further enhance the advantageous effects, the outer surface of the belt can comprise 5000 to 15,000 shallow portions per square meter ($m^2$).

The shallow portions 30 can have an average length 34 in a range between 8 mm and 25 mm, measured from the first dewatering groove 21 in the first direction. Alternatively, or in addition, the deep portions 40 can have an average length 44 in a range between 20 mm and 60 mm, measured from the first dewatering groove in the first direction. The technical effect is to improve dewatering properties of the belt to a substantial extent. Another technical effect is to achieve a good moisture profile for the fiber web to be manufactured.

The shallow portions can be arranged in such a way that each shallow portion extends from a bottom of the first dewatering groove in a direction forming an angle of at least 5° and equal to or less than 90° to the bottom of the first dewatering groove. Preferably, the shallow portion(s) extends from a bottom of the first dewatering groove in a direction forming an angle from 10° to 80 to the bottom of the first dewatering groove. The angle has an effect on the amount of water to be removed. The technical effect is to improve fine tuning properties of the belt.

As illustrated in FIG. 2*b*, the shallow portions can be at least partially diagonally positioned. The technical effect is that the effect of the shallow portions on the dewatering can maintain at any position of the belt.

In an embodiment, the shallow portions have, in the first direction, a cross directional shape of at least one of

- a square,
- a rectangle,
- a rectangle having at least one curved side and/or at least one curved edge,
- a triangle,
- a triangle having at least one curved side and/or at least one curved edge,
- a trapezium, and
- a trapezium having at least one curved side and/or at least one curved edge.

The technical effect of such shapes of the shallow portions is to improve its dewatering properties.

The shallow portion can comprise at least one curved side in the first direction. The shallow portion can comprise one or more concave sides in the first direction. The technical effect is to enhance the removal of water from the dewatering grooves. Another technical effect is to improve durability of the shallow portions in use.

The shallow portion can be shaped to have a downwards opening, such as substantially upside-down U-shaped or V-shaped cross section in the first direction. The technical effect is to improve dewatering properties as such shaped shallow portion acts particularly well with the deep portions for removing water from the first dewatering groove.

The shallow portion(s) can be arranged to taper so that a cross sectional area, determined in the first direction, decreases towards to the outer surface. Thus, the shape of the shallow portion may taper from the bottom of the shallow portion to the top of the shallow portion. The technical effect is to keep grooves clean e.g., from small fibers, filling additives, etc., and improve water removal from the dewatering grooves.

The effect of the shallow portions is typically enhanced when the number of dewatering grooves comprising said shallow portions is increased. Preferably, a number of first dewatering grooves is at least 140/m, more advantageously at least 200/m and preferably at least 230/m, and advantageously not greater than 670/m, more advantageously not greater than 560/m, and preferably not greater than 500/m determined as number of the first dewatering grooves in the second direction.

The total water volume of the dewatering grooves can be between 100 and 800 ml/m$^2$, preferably between 200 ml/m$^2$ and 600 ml/m$^2$, and more preferably between 300 ml/m$^2$ and 500 ml/m$^2$. The technical effect is to enhance dewatering of the fiber web to be dewatered.

The belt is typically intended to be installed in a pulp drying machine, a board machine, or a paper machine.

The belt can be intended to be installed on a sleeve roll, or a shoe press of a fiber web machine.

The belt can be manufactured by methods known by a person skilled in the art.

Referring to FIG. 2*a*, the belt may have, in an example, outer edges 16 and/or a plurality of attaching points 15 of the belt for an improved installation of the belt. The belt may further comprise, for example, a reinforcing structure (not shown in the figures) for improving strength properties of the belt. The reinforcing structure, if used, may comprise, for example, yarns. In an example, the body 14 may contain polyurethane, such as at least 50 wt. % polyurethane, calculated from the total weight of the belt.

The invention has been described with the aid of illustrations and examples. The invention is not limited solely to the above presented embodiments but may be modified within the scope of the appended claims.

We claim:

1. A belt for a fiber web machine, the belt having an inner surface and an outer surface, wherein the belt comprises a plurality of parallel dewatering grooves extending in a machine direction beneath the outer surface of the belt, each dewatering groove having a width in a cross direction which is parallel to the machine direction, wherein each dewatering groove comprises:

- shallow portions having a first depth which is recessed below the outer surface; and
- deep portions having a second depth which is recessed below the outer surface an amount which is greater than the first depth, which first and second depths are determined from the outer surface of the belt in a depth direction, wherein the first depth is smaller than the second depth, wherein each dewatering groove defines a sequence of concave segments following one after another in the machine direction, with a discontinuity between adjacent concave segments.

2. The belt of claim 1, wherein a number of the shallow portions within each of the dewatering grooves is 1/m to 50/m, measured in the machine direction.

3. The belt of claim 1, wherein the second depth is in a range between 0.8 mm and 1.6 mm.

4. The belt of claim 1, wherein the first depth is 5 to 25 percent of the second depth, determined from the outer surface of the belt in the depth direction.

5. The belt of claim 1, wherein the first depth is in a range between 0.02 mm and 0.4 mm.

6. The belt of claim 1, wherein the belt has a thickness in the direction of the first depth, and wherein the first depth is at least 0.2% with respect to the thickness of the belt.

7. The belt of claim 1, wherein the belt has a thickness in the direction of the first depth, and wherein the second depth is equal to or more than 6% of the thickness of the belt and/or equal to or less than 30% of the thickness of the belt.

8. The belt of claim 1 wherein the sequence of concave segments of each dewatering groove has a plurality of shallow portions spaced apart from one another by deep portions, and wherein imaginary central lines are defined passing through a center of each shallow portion running perpendicular to the first direction, and wherein a distance between central lines of two nearest shallow portions is at least 20 mm and not greater that 100 mm.

9. The belt of claim 1, wherein the shallow portions are arranged to taper so that a cross sectional area of the first groove taken along a plane perpendicular to the first direction increases running from a shallow portion to a deep portion.

10. The belt of claim 1 wherein the shallow portions comprise one or more curved sides.

11. The belt of claim 1, wherein the shallow portions have an average length in a range between 8 mm and 25 mm, measured in the first direction.

12. The belt of claim 1, wherein the deep portions have an average length in a range between 20 mm and 60 mm, measured in the first direction.

13. The belt of claim 1, wherein the shallow portions are arranged in such a way that each shallow portion extends from a bottom of the first dewatering groove in a direction forming an angle of at least 5° and equal to or less than 90° to the bottom of the first dewatering groove.

14. The belt according to claim 1, wherein a width of the shallow portions is at least 8% of the width of the first dewatering groove.

15. The belt of claim 1, wherein at least 99% of dewatering grooves comprise the shallow and deep portions.

16. The belt of claim 1 wherein the dewatering grooves are arranged to form a total volume for water of from 100 to 600 ml per $m^2$ of belt surface.

17. A belt for a fiber web machine, the belt having an inner surface and an outer surface, wherein the belt comprises:

a plurality of parallel dewatering grooves which extend in a machine direction and which open on the outer surface of the belt, each dewatering groove having a width measured in a cross direction perpendicular to the machine direction;

wherein each of the plurality of parallel dewatering grooves has a plurality of concave groove segments, each groove segment having a central deep portion extending a second depth beneath the outer surface and shallow portions recessed below the outer surface, a shallow portion being positioned on either side of each deep portion, and each shallow portion extending beneath the outer surface a first depth that is less than the second depth, such that each concave groove segment has a deep portion between two shallow portions; and wherein transition portions which extend in a continuous transition in depth from the first depth to the second depth of the deep portions on opposite sides of the shallow portion, the transition portions being a gradual change in depth below the outer surface in the machine direction, wherein the plurality of concave groove segments within each parallel dewatering groove define a sequence of concave portions following one after the other.

18. The belt of claim 17, wherein the shallow portions are arranged in such a way that each shallow portion extends from a bottom of its dewatering groove in a direction forming an angle of at least 5° and equal to or less than 90° to the bottom of said dewatering groove.

19. The belt of claim 17 wherein the transition portions of each shallow portion define curved sides of said shallow portion.

* * * * *